US005478001A

United States Patent [19]

Pillsbury et al.

[11] Patent Number: 5,478,001

[45] Date of Patent: Dec. 26, 1995

[54] METHOD AND APPARATUS FOR MONITORING COIL STOCK FEED

[75] Inventors: Lloyd Pillsbury, West Chester, Ohio; Chris McKinnell, Lititiz, Pa.; Barry Spockton, Lake Bluff, Ill.

[73] Assignee: Industrial Innovations, Inc., Sharonville, Ohio

[21] Appl. No.: 276,560

[22] Filed: Jul. 18, 1994

[51] Int. Cl.[6] ..... B65H 20/00; B65H 43/00; B26F 1/00

[52] U.S. Cl. ..... 226/8; 226/24; 226/45; 83/13; 83/66

[58] Field of Search ..... 226/24, 27, 2, 226/8, 32, 45, 139, 148, 162; 83/13, 66, 226; 382/8

[56] References Cited

U.S. PATENT DOCUMENTS

| | | | |
|---|---|---|---|
| 1,783,947 | 12/1930 | Sommer | 192/125 A |
| 3,229,556 | 1/1966 | Jensen | 83/66 |
| 3,393,589 | 7/1968 | Mills | 83/13 |
| 3,709,078 | 1/1973 | Mills | 83/226 |
| 3,979,980 | 9/1976 | Biester et al. | 83/13 |
| 4,070,723 | 1/1978 | Jess et al. | 83/276 |
| 4,633,742 | 1/1987 | Gutowski et al. | 83/13 |
| 4,737,904 | 4/1988 | Ominato | 364/167 |
| 5,091,962 | 2/1992 | Malloy et al. | 382/8 |
| 5,310,105 | 5/1994 | Mills | 226/24 |

OTHER PUBLICATIONS

Tech Update "New Device Gives Positive Press Feed Control" reprinted from Jan. 1991 issue Metal Forming Magazine.

Brochure entitled "One Source for All Your Count & Control Needs" Catalog D-502U, Jul. 1, 1993, published by Danaher Controls.

*Primary Examiner*—John M. Jillions

*Attorney, Agent, or Firm*—Wood, Herron & Evans

[57] ABSTRACT

A feed monitor for providing a selectable midcycle coil stock feed check on a mechanical power press. A midcycle position of the coil stock feed from which the press can be stopped prior to the reciprocating die contacting the coil stock is chosen. With each reciprocating cycle of the die, a desired midcycle coil stock feed length is compared to a measured midcycle feed length. The press is stopped if the difference between the desired and measured feed lengths is greater than a predetermined tolerance. If the measured midcycle feed length is within the tolerance, the press operation continues.

11 Claims, 3 Drawing Sheets

METHOD AND APPARATUS FOR MONITORING COIL STOCK FEED

BACKGROUND OF THE INVENTION

The present invention relates generally to controls that monitor the feeding of coil stock between reciprocating dies of a mechanical power press. More particularly, the invention relates to an adjustable coil stock feed check point which may be selectively used to interrupt coil stock feed and the press cycle prior to the dies contacting the coil stock.

Mechanical power presses include hydraulic presses, crank driven power presses, press brakes, shears and other machinery for working coil stock by continuously executing and repeating a coil stock feed cycle. Referring to a crank driven power press, for example, has a rotating crankshaft with a horizontal axis of rotation in which the eccentric of the crankshaft is connected by a connecting rod to a die. Typically, an electric motor is connected to a fly wheel through a clutch and brake which is selectively engaged and disengaged to rotate the crankshaft through a full 360° revolution. With each revolution of the crankshaft, the moveable die is reciprocated through one complete cycle moving toward and away from a stationary die. A coil stock feed device is coupled to the rotating crankshaft of the press or, is otherwise independently powered, to incrementally translate coil stock material between the moveable and stationary dies. The translation of the coil stock is synchronized with the rotation of the crankshaft.

A point on the eccentric of the crankshaft moves through a circular path in a vertical plane which has four reference points of interest. A top, or 12 o'clock, reference point, also known as the top dead center point, is the point at which the eccentric on the rotating crank and the reciprocating die attached thereto are at their highest position with respect to the frame. A bottom, or 6 o'clock, reference point, that is, the bottom dead center point, is the point at which the eccentric and the reciprocating die rotatably attached thereto are at their lowest position with respect to the frame. At the bottom reference point, the reciprocating die is closest to and may be in contact with the stationary die and is effective to perform work on the coil stock located between the dies. Typically, the top and bottom reference points are also defined by the intersection points of a vertical diameter across the circular path of the eccentric of the crankshaft.

In a typical production cycle of operation of the press, an upstroke reference point is selected as a material feed start point, that is, the point at which the coil stock feed device initiates an incremental translation of the coil stock between the moveable and stationary dies. The eccentric on the crankshaft passes the top reference point and moves downward along the circular path to a downstroke reference point which is selected as a material feed stop point, that is, the point at which the coil stock feed device terminates the incremental coil stock feed through the dies. The exact locations of the material feed start and stop points relative to the circular path of the eccentric is a function of the desired length of material feed, the type of press feed being used, the application and to some extent the discretion of the operator setting up the press cycle. The coil stock may start feeding at any point after the dies and pilots clear the coil stock on the upstroke. The feed is typically completed at the 3 o'clock position, but it may be completed at any point prior to the coil stock being contacted by the dies. After the coil stock feed is stopped, as the eccentric of the crankshaft continues its rotation toward the bottom reference point, the dies come closer together; and pilot pins or other devices on the dies precisely locate the coil stock within the die prior to the dies reaching a working position, that is, any position of the dies relative to the coil stock at which the dies are in contact with the coil stock and performing work on the coil stock. Most typically the working positions of the dies occur when the eccentric on the crank is close to the bottom reference point.

The above described production cycle is operated at a high repetition rate, and a misfeed of the coil stock can cause substantial damage and economic loss. Therefore, there are devices which measure a feed increment, detect a misfeed of the coil stock and stop the production cycle of operation in response to detecting a misfeed. For example, in U.S. Pat. No. 3,393,589, a measuring device is disclosed which measures the length of feed of the coil stock during a cycle of operation of the press. If the feed is inaccurate, a signal is produced which is effective to stop the feed cycle. With the '589 patent and other coil stock feed measuring devices, a signal to stop a cycle of operation is not generated until the end of the coil stock feed which corresponds to the point when the eccentric of the rotating crank is at the downstroke reference point. Typically, the press is designed to stop the crank when the eccentric is at the 12 o'clock, top reference point so that gravity can be used as a decelerating force when the brake is engaged. Therefore, after a coil stock misfeed is detected, the dies in the press are brought together and pass the 6 o'clock, down stroke reference point at least one time prior to the press stopping at the at the next 12 o'clock, top reference point.

The above cycle of operation has the disadvantage of bringing the dies together and executing at least one working stroke after a misfeed has been detected. The extent of damage from a misfeed depends on the extent to which the coil stock is misfed, die design, and how quickly the problem is detected. In some cases, the press can continue to operate without damage to the dies, but it produces parts which are out of tolerance and scrap. In other cases, with slight misfeeds, the pilots and die punches, which are frequently made of a brittle carbide material, may be broken. More severe damage to the dies may also occur; but in either case, any damage requires that the press be taken out of production, the dies removed therefrom, taken to a tool room for reworking and repair, and then returned and reinstalled on the press. The press may or may not be idle during the time of die repair, however, the above represents a significant economic loss to repair damage that might otherwise be preventable.

In view of the above, it would be preferable to stop the feed cycle of the press prior to the dies or the pilots on the dies contacting the coil stock. Production rates of presses range from approximately 10 to 600 strokes of the reciprocating die per minute. Assume for purposes of illustration that the coil stock stops feeding at the 3 o'clock position and the dies contact the coil stock at the 6 o'clock position. At a typical press production rate of 120 strokes per minute, the period of time between the eccentric and the crankshaft passing the 3 o'clock, downstroke reference point and reaching the 6 o'clock, bottom reference point is approximately 125 milliseconds. However, after detecting a coil stock misfeed, when the eccentric of the crankshaft passes the 3 o'clock, downstroke reference point, a typical electronic control requires from 10 milliseconds to 50 milliseconds to detect the misfeed and produce a feed stop command signal. The clutch/brake solenoid responsive to that signal takes from 20 milliseconds to 30 milliseconds to operate. Further, it takes from 100 milliseconds to 1 second for the clutch connected to the solenoid to disengage the flywheel from the crankshaft and for the brake connected to the crankshaft to bring the crankshaft to a stop. Using the minimums of the above times, if a misfeed is detected at the 3 o'clock downstroke reference point, it is not possible to stop the press operating at 120 strokes per minute before the moveable die reaches the 6 o'clock, bottom reference point which is necessary to prevent the production of a scrap workpiece and/or damage to the dies.

SUMMARY OF THE INVENTION

To overcome the limitations of prior feed monitor systems described above, the present invention provides a selectable midcycle feed check so that the coil stock feed can be examined prior to the dies engaging misfed coil stock. By providing a midcycle feed check, if a midcycle misfeed is detected, the cycle of operation of the press can be stopped prior to the dies contacting the coil stock. The invention has the advantage of permitting an earlier examination of coil stock feed, thereby avoiding the production of bad parts or damage to the dies or press. The invention is particularly useful in presses doing higher precision work or running higher rates of production where a small misfeed may result in large numbers of out of tolerance workpieces or damage to the dies or press.

According to the principles of the invention and in accordance with the described embodiments, a coil stock feed monitor includes a midcycle position switch mounted on the press for producing a midcycle position signal in response to the eccentric of the crank moving past the midcycle position switch. Depending on the how the feed cycle has been set up, the midcycle position switch is typically located so that it detects the position of the coil stock approximately half way through its feed cycle, that is, at the midpoint of the coil stock feed cycle. Preferably the midcycle position switch will cause the feed monitor to measure approximately one half of the total coil stock feed length; and therefore, the midcycle position switch is typically located between the 10 o'clock position and the 2 o'clock position relative to the circular path of the eccentric. The feed monitor further includes a manual input for selectively providing a midcycle check active input signal. Further, control logic in the feed monitor is responsive to the midcycle check active input signal and the occurrence of the midcycle position signal to provide a midcycle stop signal to stop the production cycle of operation of the press if the measured midcycle feed length is outside a midcycle tolerance bandwidth determined by the midcycle feed length set point plus or minus a midcycle tolerance.

The coil stock feed monitor further includes a keypad for selectively providing a midcycle feed length reference signal representing the desired midcycle feed length set point. The keypad is also used to provide a midcycle feed length tolerance input signal defining an acceptable midcycle tolerance bandwidth around the desired midcycle feed length set point. A device for producing a signal representing the actual length of feed of the coil stock as it is fed between the dies of the press is attached to the feed monitor.

The feed monitor produces the midcycle stop signal in response to the measured midcycle feed length being outside the tolerance bandwidth defined by the midcycle feed length set point plus and minus the midcycle feed length tolerance. In addition, the feed monitor has displays indicating the extent to which the actual length of feed of the coil stock differs from the midcycle feed length set point.

These and other objects and advantages of the present invention will become more readily apparent during the following detailed description together with the drawings herein.

DETAILED DESCRIPTION OF THE INVENTION

Figure 1:
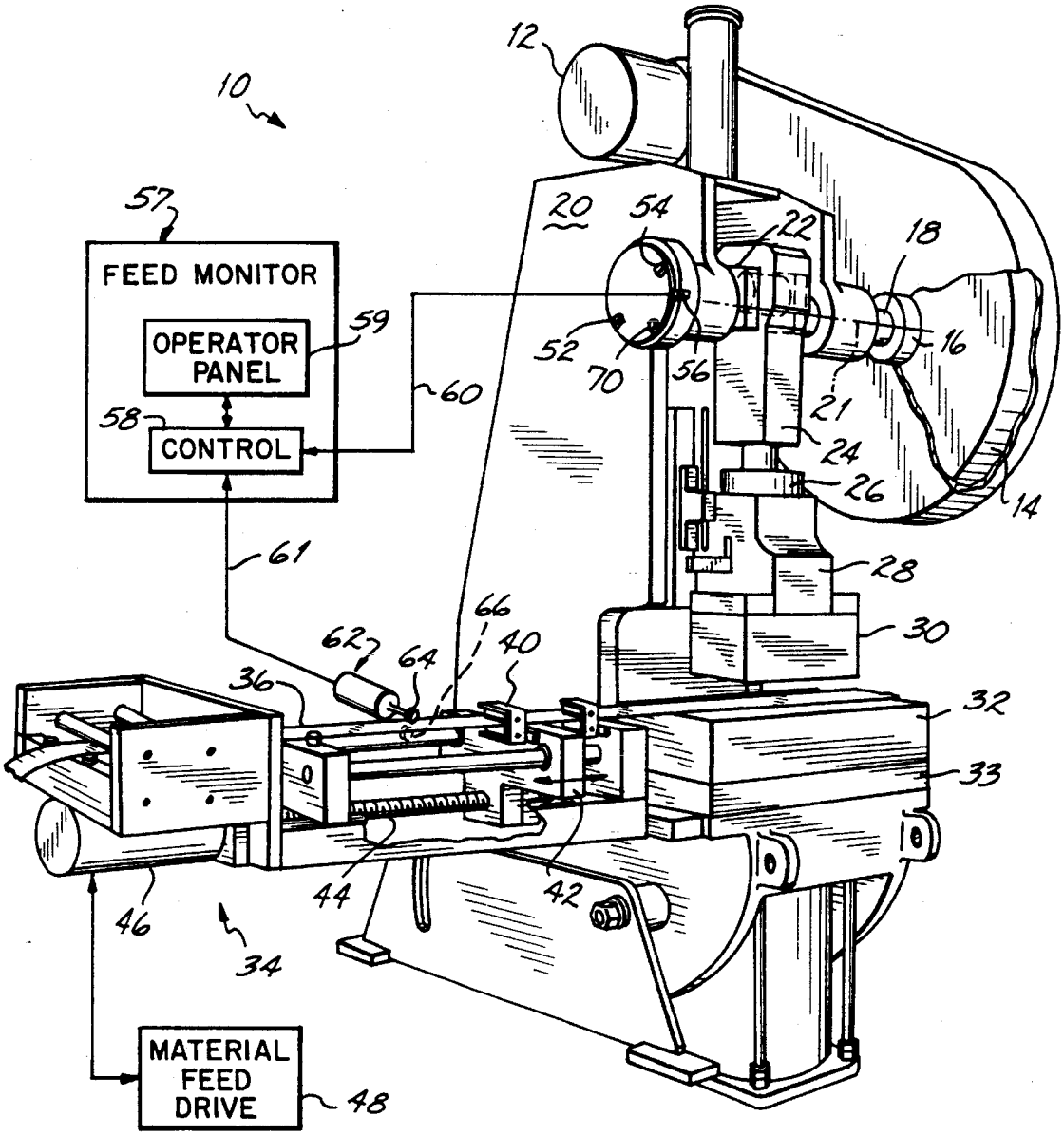
FIG. 1 is a perspective schematic view of a reciprocating press utilizing the present invention.

A reciprocating press 10 is schematically illustrated in FIG. 1. An electric motor 12 is operably connected, for example, with a pulley and belt drive to a fly wheel 14. The fly wheel 14 is connected through a clutch and brake assembly 16 to a crank shaft 18 rotatably mounted on the frame 20 of the press 10. The crank shaft has a centerline 21 shown in phantom and has an eccentric 22 rotatably coupled to one end of a connecting rod 24. The other end 26 of the connecting rod 24 is connected to a moveable platen 28 to which a moveable die 30 is attached. A stationary die 32 is mounted on a bed 33 connected on the frame 20 opposite the moveable die 30. A coil stock feeder 34 is supported on the frame 20 and is operative to translate coil stock material 36 through predetermined incremental displacements with respect to the dies 30, 32. The coil stock feeder 34 has a pair of one way gripping rollers 40 attached to a feed block 42 which is threadably mounted on a drive screw 44. The drive screw 44 is connected to a feed motor 46. The feed motor 46 is connected to a feed motor drive 48 having operator input switches which permit the operator to preselect the increment of coil stock feed with each press cycle. The mechanism coordinating the operation of the feed motor 46 to the operation of the moveable die 30 will vary with the material feeder chosen. As the operation of the feed motor 46 and drive screw 44 moves the feed block 42 toward the press 10, the pair of one-way gripping rollers 40 grip the coil stock 36 as the rollers 40 move toward the press 10 thereby pulling the coil stock with the motion of the feed block 42 and the rollers 40. However, when the feed block 42 moves the pair of one-way gripping rollers 40 away from the press 10, the rollers freely rotate relative to the coil stock 36 thereby translating away from the press and relative to the stationary coil stock. A coil stock feeder as just described is available as model DX from Dynamic Feeds Inc. of Highpoint, N.C.

The above mechanism which feeds the coil stock between the dies of the press 10 is independent of the coil stock feed monitoring system of the present invention. The coil stock feed monitoring system includes proximity transmitters 52, 54 and a proximity receiver 56 electrically coupled to a feed monitor 57 comprised of control 58 and operator panel 59. The proximity transmitter 52 is positioned on the end of the crankshaft 18 so that when it passes the proximity receiver 56, the eccentric 22 is at the coil stock feed start point, that is, the upstroke reference point. When proximity sensor 52 passes proximity receiver 56, a start feed check signal is produced on line 60 to the control 58. In response thereto, the control 58 begins monitoring a feed length signal on line 61 from an encoder 62 connected to a roller 64 engaging the coil stock 36. As the coil stock moves between the first roller 64 engaging the surface on one side of the coil stock and a second roller 66 engaging the surface of the other side of the coil stock, the first roller 64 rotates which produces a corresponding rotation of the encoder 62. The encoder produces a number of encoder pulses as a function of the rotation of the roller 64 which in turn is a function of the length of coil stock imparting a rotation to the roller 64.

A proximity transmitter 54 is positioned on the end of the crankshaft 18 such that when it passes the proximity receiver 56, the eccentric 22 is at the coil stock feed stop point, that is, the downstroke reference point. When proximity sensor 54 passes proximity receiver 56, a stop feed check signal is produced on line 60 to the control 58. Since the feed monitor 57 operates independently of the coil stock feeder 34, the proximity transmitter 52 must be carefully positioned so that the control 58 begins monitoring the encoder 62 immediately prior to any motion of the coil stock 36. Similarly, the proximity transmitter 54 must be positioned relative to the rotation of the crank shaft 18 such that the coil stock feeder 34 has stopped before the control 58 stops monitoring the feed length signal on line 61 and begins processing the coil stock feed length information.

The operator panel 59 on the feed monitor includes input switches, for example, a keypad which permits the press operator to enter a total coil stock feed length set point representing the desired total length of the coil stock to be fed into the press with each cycle of the coil stock feeder 34. In addition, the press operator uses the keypad to enter a total feed length tolerance magnitude defining a total feed length tolerance bandwidth having limits that are greater than and less than the total coil stock feed length set point. In response to a stop feed check signal on line 60, the control 58 determines whether the measured total coil stock feed length is within the total coil stock feed length tolerance limits; if the measured feed length is outside the total feed length tolerance band, an automatic press cycle stop signal is generated which is effective to stop the motion of the dies by disengaging the clutch and engaging the brake. As previously described, when the press is running at a typical production rate, for example, 120 strokes per minute, prior art feed monitor devices are unable to stop the press cycle after detecting a coil stock misfeed but before the reciprocating press die 30 contacts the work the coil stock 36.

Therefore, the feed monitor of the present invention also includes a proximity transmitter 70 which is selectively placed on the rotating crankshaft 18 to pass the proximity receiver 56 when the coil stock is approximately half way through its feed length cycle. The proximity transmitter 70 and proximity receiver 56 function as a midcycle position switch. Using the operator of panel 59, an input signal is entered to activate or deactivate the midcycle feed length check feature which causes the control 58 to accept or ignore, respectively, a midcycle position signal from the proximity transmitter 70. Further, the keypad is used to define, either directly or by manually initiating a number of individual feed cycles, a desired or expected length of coil stock feed at the time the proximity transmitter 70 passes the proximity receiver 56, that is, the midcycle feed length set point. In addition, the keypad is used to select a tolerance band which represents an incremental magnitude of coil stock feed greater than and less than the expected length of coil stock feed at the midcycle feed length check position. Consequently, during an automatic cycle of operation, the press is stopped in response to a detected midcycle coil stock misfeed. The location of the midcycle position limit switch is chosen so that the moveable die 30 can be brought to a stop prior to the die pilots engaging the coil stock after the feed monitor detects the midcycle feed length misfeed, that is, an out-of-tolerance midcycle feed length. If a misfeed has occurred, the press and/or the coil stock may be manually moved and adjusted to correct the coil stock misfeed condition. This midcycle stop of the coil stock feed prior to the dies engaging the coil stock prevents either the production of out-of-tolerance parts, or damage to the dies, or both; and repairs associated therewith and press downtime may be avoided.

Figure 2:
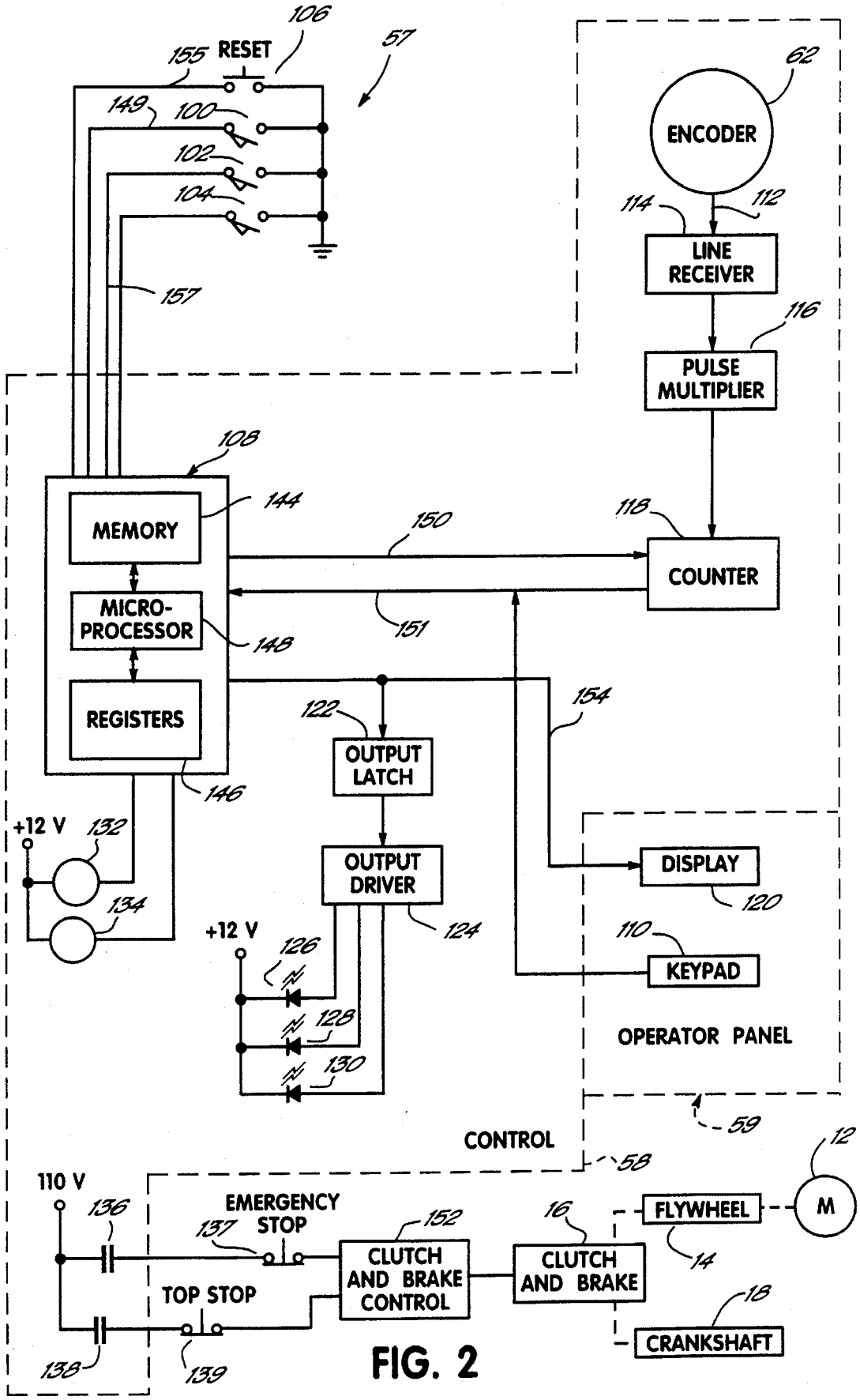
FIG. 2 is a schematic block diagram of the feed monitor shown in FIG. 1.

FIG. 2 is a schematic block diagram of the control 58 and operator panel 59 comprising the feed monitor 57. Proximity transmitter 52 and proximity receiver 56 of FIG. 1 operate as a start feed length check limit switch 100 of FIG. 2. Similarly, proximity transmitter 54 and proximity receiver 56 of FIG. 1 operate as a stop feed length check limit switch 102. Further, proximity transmitter 70 and proximity receiver 56 operate as a midcycle position limit switch 104. The limit switches 100–104 and reset pushbutton 106 provide discrete binary inputs to a single board computer 108 within the control 58. The single board computer 108 is model SBC88A commercially available from Vesta Technology, Inc. of Wheat Ridge, Colo. The computer 108 receives other input signals on an input port from a keypad 110 within the operator panel 59. The keypad 110 is utilized to provide input data, for example, desired feed length set points and feed length tolerance parameters, for the feed monitor 57. A display 120 within the operator panel 59 permits the computer 108 to display messages to the press operator either for information purposes or to seek input data from the operator.

An incremental encoder 62 produces a feed length signal in the form of 2500 pulses per revolution on an output line 112 which is connected to a line receiver 114. The line receiver 114 shapes the encoder pulses for the pulse multiplier 116. The pulse multiplier 116 may be implemented with a quad generator which is effective to provide four discrete pulses for each pulse produced by the encoder 62 and thereby providing 10,000 discrete pulses per encoder revolution. A high speed counter 118 which includes five 16 bit counters consecutively counts the pulses produced from the pulse multiplier 116 during the periods determined by the limit switches 100–104. An output latch 122 is connected to an output port of the computer 108 and functions to latch various output signals produced from the computer. An output driver 124 is connected to the output latch 122 and provides signals to LED's 126, 128, and 130. In addition, the computer 108 produces discrete output signals to energize relay coils 132 and 134 which are operative to close contacts 136 and 138, respectively. The computer 108 has a memory 144 which stores the instructions for various operating programs used to operate the feed monitor 57. In addition, the memory stores setup data established by the press operator during a setup mode. The computer contains registers 146 which may function either as a memory, a counter, a comparator, etc. depending on the requirements and commands of the instructions within the operating programs stored in the memory 144. The instructions within the operating programs are read and executed by microprocessor 148 within the computer 108 and controlling the operation of the feed monitor 58.

In use, one of three modes of feed monitor operation may be selected by an operator. In a settings mode, the program stored in the feed monitor provides a fixed sequence of events wherein each event displays a message on the display 120 of the operator panel 59. The message asks for a piece of information or data from the press operator, and the event is ended by the operator providing that information or data utilizing the keypad 110. That data is stored by the microprocessor 148 in either the memory 144 or the registers 146. The settings mode uses the display 120 to sequentially request data relating to the total coil stock feed length, the magnitude of the total feed length tolerance, the midcycle feed length, the midcycle tolerance magnitude, a selection of whether the midcycle feed length check is turned on or off, and a selection of whether the relays 132, 134 are to be energized in the event of an error condition.

Depending on the application of the feed monitor, additional setup parameters may also be solicited from the press operator. The total feed length and the midcycle feed length are entered in dimensional units, for example, inches and may be expressed in increments of 0.001". The feed tolerance magnitude is a value that is added to and subtracted from the desired feed length to establish upper and lower limit values of a tolerance bandwidth. Therefore, during the operation of the feed monitor, measured lengths of coil stock feed that are respectively less than and greater than the upper and lower limit values, that is, within the tolerance bandwidth, are considered acceptable. Similarly the midcycle tolerance defines predetermined increment of feed length which when added and subtracted from the midcycle set point defines a midcycle tolerance bandwidth within which measured values of the midcycle feed length are considered acceptable. The tolerance magnitudes are typically expressed in increments of 0.001".

Prior to executing an automatic run cycle of operation, the feed monitor must be calibrated to establish a scaling factor so that the computer 108 can assign a dimensional increment of coil feed to each pulse counted by counter 118. This scaling factor may be established when the computer 108 is manufactured and tested. However, the roller 64 of FIG. 1, connected to the shaft of encoder 62, may experience wear or slightly change in shape or size for some other reason. Therefore, it is desirable to periodically recalibrate the feed monitor. This may be done in several ways. One method is to execute a calibration cycle within the settings mode of operation in which the press is cycled through a predetermined number of coil stock feeds. Information defining the number of feed cycles and the desired length of each feed cycle executed in the calibration cycle is entered and stored in the computer 108. At the end of the execution of the number of feed cycles, the computer 108 reads the total number of pulses counted in the counter 118. In addition, the operator measures the actual length of coil stock fed and enters that length into the computer 108 via the keypad 110. Given that data, the computer 108 then calculates a scaling factor that is subsequently used to convert the number of pulses counted by the counter 118 into dimensional units coil stock feed length.

A setup mode of operation may also be used to establish operating parameters. For example, to establish the midcycle feed length set point, the operator executes five individual cycles of operation in which the cycle is stopped by the midcycle position limit switch 104, the display 120 provides a readout of the length of coil stock fed with each cycle; the operator enters the average of those readings as the midcycle feed length set point using the settings mode of operation. In addition, after a press cycle has been completely defined, the setup mode of operation may be used by the operator to manually initiate a portion or a whole cycle of press operation to check the coil stock feed before the press is operated in the continuous automatic run mode of operation.

Figure 3:
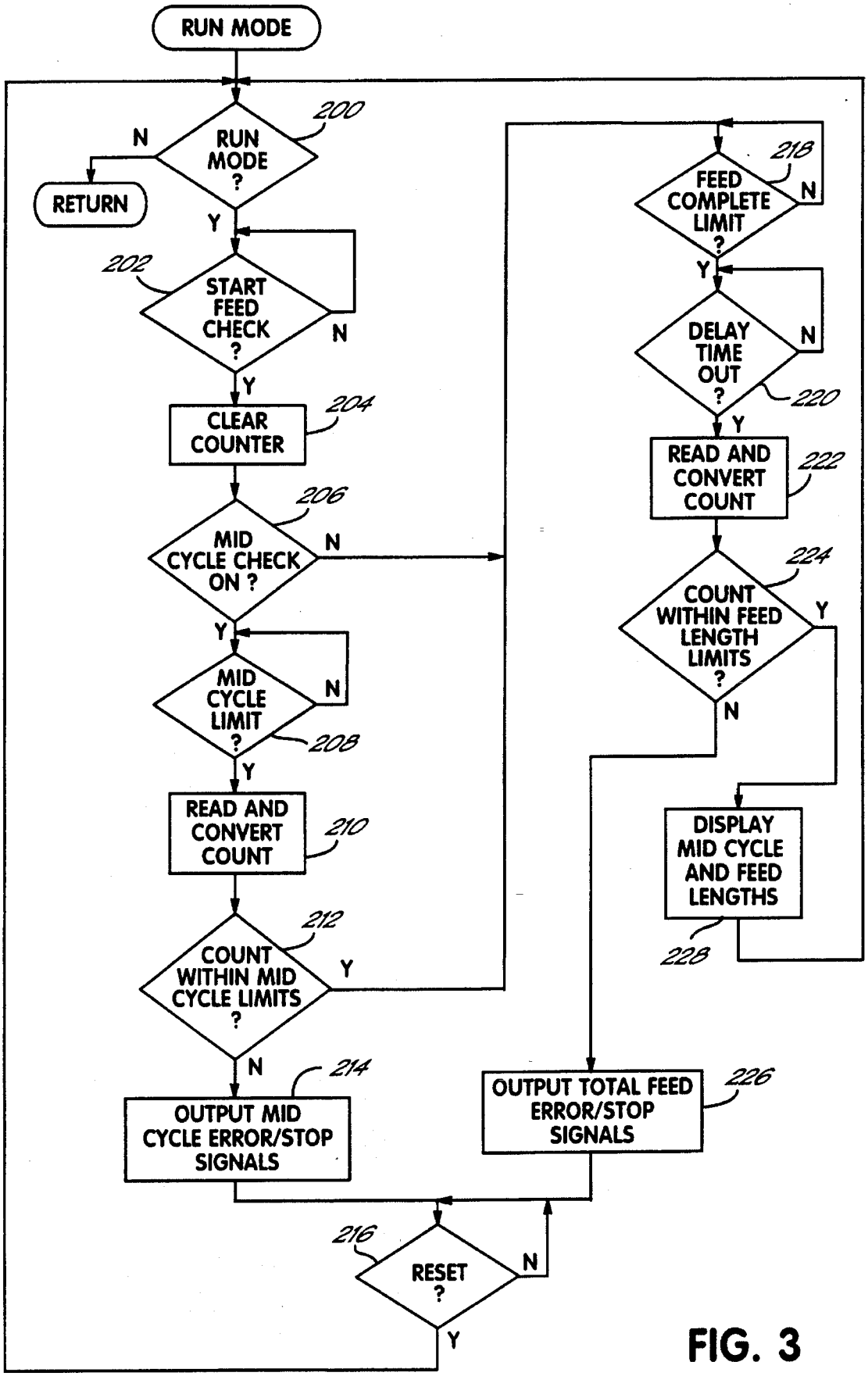
FIG. 3 is a flowchart illustrating the steps of the process by which the feed monitor executes a run cycle which includes a midcycle check of feed length.

FIG. 3 is a flowchart illustrating the general steps of a process executed by the fluid monitor of FIG. 2 in executing a run mode of operation in which the press is continuously operated through repetitive cycles. The process first determines at 200 whether the press operator has selected the run mode of operation. If so, the computer 108 waits for the press to be put into operation and for the activation of the start feed length check limit switch 100 which produces a start feed length check signal on line 149 to the computer 108. When the switch closure is detected at 202, the computer 108 produces a reset or clear signal on line 150 to the counter 118. After the counter is cleared or reset at 204, the process determines at 206 whether the press operator has turned on, that is, activated, the midcycle feed length check feature. If so, the computer 108 waits for closure of the midcycle position limit switch 104 which produces a midcycle position input signal on line 151. When the process at 208 detects a midcycle position switch closure, the computer 108 reads the number of pulses counted by the counter 118 after it was last reset. In addition, the process at 210, instructs the computer 108 to apply the calibrated scaling factor to the read count and to store the measured midcycle coil stock feed length in dimensional units, for example, inches.

If the process at 212 determines that the measured midcycle feed length is outside the midcycle tolerance bandwidth defined by the midcycle feed length set point and the midcycle tolerance parameter, the computer 108 will output a midcycle error signal on line 154 as indicated by the process at 214. The midcycle error signal is detected and held by output latch 122. Output driver 124 is responsive to the latched midcycle error signal and causes the midcycle error LED 130 to illuminate. Further, if selected during the setup mode, the feed monitor is also used to switch a discrete output, for example contacts 136 associated with relay coil 132. Switching a discrete output may be used to provide one or more functions.

For example, during a normal cycle of press operation, the relay coil 132 is maintained in an energized state which maintains the normally open contacts 136 closed. The contacts 136 are connected in a series circuit with normally closed contacts on an emergency stop pushbutton 137 and an input to a clutch and brake control 152. Maintaining a signal in that series circuit to the clutch and brake control 152 is effective to cause the clutch and brake control to maintain the clutch engaged and the brake disengaged. In the event of a midcycle feed length error condition, the computer 108 will deenergize the coil 132 which causes the normally open contacts 136 to open, thereby removing the input from the clutch and brake control 152. Opening the contacts 132 represents a midcycle stop signal which will cause the clutch and brake control 152 to disengage the clutch and energize the brake, thereby stopping the rotation of the crankshaft 18 before the reciprocating die contacts the coil stock. After a midcycle error is detected and the press is stopped, the press operator can check the nature of the problem. If necessary, the material can be cleared or other action taken; and the operator then moves the press to its start cycle position. If a midcycle error is detected, the control process at 216 maintains the error signal outputs until, after adjusting or clearing the fault and/or resetting the press, the operator activates a reset button 106. The activated reset button provides a reset input signal on line 155 and causes the computer 108 to remove or reset the outputs representing the error signals. Thereafter, the process returns to step 200 and determines whether the feed monitor is still in the run mode. If so, the process at 202 awaits the next closure of the start feed length check limit switch 100.

If the midcycle check is not activated at 206, or if the midcycle feed length is within the midcycle tolerance bandwidth, then the run mode at 218 awaits the closure of the stop feed length check limit switch 102. Upon the computer 108 detecting a stop feed length check input signal on line 157, a predetermined time delay in the range of from 10 milliseconds to 50 milliseconds is counted by the process at 220 prior to reading the count in counter 118. The time delay permits various mechanical elements of the system to settle out and stabilize so that a more accurate count is read. At the end of the time delay, pursuant to the process at 222, the computer 108 reads the count in the counter 118 and uses the calibrated scaling factor to convert the number of counts to a dimensional unit, for example, inches of material feed. The resulting total coil stock feed length is stored; and at 224, the computer 108 determines whether the total coil stock feed length is within the tolerance band established by the total feed length set point and the total feed length tolerance limits. If not, at 226, the process causes computer 108 to produce a total feed length error signal on line 154 which is effective to illuminate the feed error LED 128 and optionally stop the operation of the crankshaft 18. In a similar manner as previously described, during a normal machine cycle of operation, normally open contacts 138 are maintained closed by the computer 108 holding coil 134 energized. Contacts are in a series circuit with normally closed contacts from a top stop switch 139 connected to another input of the clutch and brake control. If a total feed length error condition exits, the computer 108 is effective to deenergize the coil 134, thereby opening the contacts 138. Opening the contacts 138 effectively operates as a total feed length error signal and causes the clutch and brake control to disengage the clutch, engage the brake and stop the crankshaft 18.

If the process at 224 determines that the feed length is within the desired tolerances, the process at 228 causes computer 108 to produce a feed OK signal on line 154 which is detected by output latch 122. The output driver 124 is responsive to the latched feed OK signal and illuminates the feed OK LED 126. In addition, the computer 108 produces other outputs on line 154 to cause the display 120 to display the midcycle feed length and the total feed length. Thereafter, the process at 200 again determines whether the run mode is still active. If it is, the process waits for a subsequent closure of the midcycle position limit switch. If the run mode has been deactivated, the run mode process is terminated.

While the present invention has been set forth by a description of an embodiment in considerable detail, it is not intended to restrict or in any way limit the claims to such detail. Additional advantages and modifications will readily appear to those who are skilled in the art. For example, other proximity sensors, such as infrared proximity detectors or other types of position sensors may be used in place of the proximity transmitters 52, 54, 70 and proximity receiver 56. While the location of the midcycle position is preferably discussed in terms of the midpoint of the coil stock feed cycle, the midcycle position may be at any point intermediate the beginning and the end of the coil stock feed cycle that permits the reciprocating die to stop prior to contacting the coil stock after a midcycle stop signal is produced. Further, the counter 118 may alternatively be implemented by using registers 146 within the computer 108. In addition, the utilization of a line receiver 114 and pulse multiplier 116 is a function of the desired resolution and the choice of the encoder 62 and other factors; and therefore, in some applications, the line receiver 114 and pulse multiplier 116 may not be used. Further, any one of many commercially available coil stock feeders may be used in conjunction with the invention. Such coil stock feeders include those which are powered by a drive shaft mechanically connected to the press, as well as those which are coordinated to the operation of the crankshaft by electronic or other means. Further, contacts from the relays 132, 134 may be used to operate other warning devices either audible or visual. The invention is its broadest aspects is therefore not limited to the specific details shown and described. Accordingly, departures may be made from such details without departing from the scope of the invention.

What is claimed is:

1. A feed monitor of the type for measuring a length of coil stock being fed to a mechanical power press during a coil stock feed cycle, the coil stock feed cycle causing coil stock to be fed with respect to and in synchronization with motion of a reciprocating die relative to a stationary die during a cycle of operation of a press, the reciprocating die being operably connected to a rotating mechanism supported by a frame of the press, the feed monitor comprising:

a first detector operably connected to the press for producing a feed length start check signal in response to the rotating mechanism being at a first position corresponding to a start of the coil stock feed cycle;

a second detector operably connected to the press for producing a midcycle position signal in response to the rotating mechanism being at a position intermediate the first and the second positions from which the press can be stopped prior to the reciprocating die contacting the coil stock; and a control connected to the first and the second detectors and including a sensor responsive to feeding of the coil stock and connected to the control for producing a measured feed length signal as a function of a measured length of the coil stock;

a data entry circuit for selectively providing a midcycle feed length reference signal representing a desired length of feed of the coil stock when the third detector produces the midcycle position signal, and a logic circuit responsive to the midcycle position signal, the measured feed length signal and the midcycle feed length reference signal for producing a midcycle stop signal the midcycle stop signal causing the cycle of operation of the press to stop prior to the reciprocating die contacting the coil stock.

2. The feed monitor of claim 1 wherein the data entry circuit further selectively provides a midcycle stop signal and the logic circuit is responsive to the midcycle stop active signal prior to producing the midcycle stop signal.

3. The feed monitor of claim 1 wherein the feed monitor further includes:

a display for producing a visual display representing a difference between the desired and measured lengths of feed of the coil stock.

4. The feed monitor of claim 3 wherein the data entry circuit further selectively provides a midcycle tolerance input signal representing a midcycle tolerance which is a predetermined increment greater than and less than the desired length of feed of the coil stock.

5. The feed monitor of claim 4 wherein the display produces a visual display representing the measured length of feed of the coil stock in response to the measured length of coil stock feed being greater than or less than the desired length of coil stock feed plus or minus the midcycle tolerance.

6. The feed monitor control of claim 5 wherein the logic circuit produces the midcycle stop signal in response to the measured length of feed of the coil stock being greater than or less than the desired length of coil stock feed plus and minus, respectively, the midcycle tolerance.

7. A method of monitoring a length of coil stock being fed with respect to and in synchronization with motion of a reciprocating die relative to a stationary die during a cycle of operation of the press, the coil stock being fed between the reciprocating and a stationary dies during a coil stock feed cycle, the method comprising the steps of:

(a) selecting a midcycle position of the coil stock feed cycle from which the press can be stopped prior to the reciprocating die contacting the coil stock;

(b) providing a midcycle feed length set point representing a desired midcycle length of coil stock feed through a portion of the coil stock feed cycle;

(c) initiating the cycle of operation of the press;

(d) initiating the coil stock feed cycle after initiating the cycle of operation of the press;

(e) detecting motion of the reciprocating die past the midcycle position of the coil stock feed cycle (f) measuring a midcycle feed length of the coil stock in response to detecting motion of the reciprocating die past the midcycle position of the coil stock feed cycle (g) producing a midcycle stop signal in response to a measured midcycle feed length of the coil stock being different from the midcycle feed length set point; and (h) stopping the cycle of operation of the press prior to the reciprocating die contacting the coil stock in response to the occurrence of the midcycle stop signal.

8. The method of claim 7 further comprising the step of iterating steps (c) through (f) in response to the measured midcycle feed length of the coil stock being substantially equal to the midcycle feed length set point.

9. The method of claim 8 wherein the method further comprises the step of providing a midcycle tolerance representing predetermined increment of length of coil stock feed.

10. The method of claim 9 wherein the step of producing a midcycle stop signal further comprises producing the midcycle stop signal in response to the actual measured midcycle feed length of the coil stock being outside a midcycle tolerance bandwidth defined by the desired midcycle length of coil stock feed and the predetermined increment of length of coil stock feed.

11. The method of claim 10 further comprising the step of providing a midcycle check active input signal and the step of producing the midcycle stop signal is further responsive to the midcycle check active signal.

* * * * *